US010083705B2

(12) United States Patent
Kovesi et al.

(10) Patent No.: US 10,083,705 B2
(45) Date of Patent: Sep. 25, 2018

(54) DISCRIMINATION AND ATTENUATION OF PRE ECHOES IN A DIGITAL AUDIO SIGNAL

(71) Applicant: Orange, Paris (FR)

(72) Inventors: Balazs Kovesi, Lannion (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 15/510,831

(22) PCT Filed: Sep. 11, 2015

(86) PCT No.: PCT/FR2015/052433
§ 371 (c)(1),
(2) Date: Mar. 13, 2017

(87) PCT Pub. No.: WO2016/038316
PCT Pub. Date: Mar. 17, 2016

(65) Prior Publication Data

US 2017/0263263 A1 Sep. 14, 2017

(30) Foreign Application Priority Data

Sep. 12, 2014 (FR) ..... 14 58608

(51) Int. Cl.
*G10L 19/26* (2013.01)
*G10L 25/51* (2013.01)
(Continued)

(52) U.S. Cl.
CPC ..... *G10L 19/26* (2013.01); *G10L 19/0204* (2013.01); *G10L 25/21* (2013.01); *G10L 25/51* (2013.01)

(58) Field of Classification Search
CPC ..... G06F 17/00
See application file for complete search history.

(56) References Cited

U.S. PATENT DOCUMENTS 8,676,365 B2 3/2014 Kovesi et al.
2009/0313009 A1* 12/2009 Kovesi ..... G10L 19/24 704/203
(Continued)

FOREIGN PATENT DOCUMENTS

| | | | |
|---|---|---|---|
| FR | 1262598 | A | 6/1961 |
| FR | 3000328 | A1 | 6/2014 |
| WO | 2010031951 | A1 | 3/2010 |

OTHER PUBLICATIONS

English translation of the Written Opinion of the International Searching Authority dated Nov. 10, 2015 for corresponding International Application No. PCT/FR2015/052433, filed Sep. 11, 2015.
(Continued)

*Primary Examiner* — Shreyans Patel
(74) *Attorney, Agent, or Firm* — David D. Brush; Westman, Champlin & Koehler, P.A.

(57) ABSTRACT

A method for discriminating and attenuating pre-echo in a digital audio signal and generated from transform coding. The method includes the following acts in which, for a current frame broken down into sub-blocks, the low-energy sub-blocks precede a sub-block in which a transition or attack is detected, and determine a pre-echo area in which a pre-echo attenuation process is carried out. In the event that an attack is detected from the sub-block of the current frame, the method includes: calculating an energy leading coefficient for at least two sub-blocks of the current frame preceding the sub-block in which an attack is detected; comparing the leading coefficient to a predefined threshold; and inhibiting the pre-echo attenuation process in the pre-echo area in the event that the calculated leading coefficient is lower than the predefined threshold. Also provided are a
(Continued)

discrimination and attenuation device implementing the acts of the method described and a decoder including such a device.

10 Claims, 8 Drawing Sheets

(51) Int. Cl.
*G10L 25/21* (2013.01)
*G10L 19/02* (2013.01)

(56) References Cited

U.S. PATENT DOCUMENTS

2012/0173247 A1* 7/2012 Sung ..... G10L 19/002 704/500
2015/0170668 A1* 6/2015 Kovesi ..... G10L 19/26 381/66
2015/0348561 A1* 12/2015 Kovesi ..... H04B 3/21 704/226
2016/0232907 A1* 8/2016 Kovesi ..... G10L 19/04
2016/0343384 A1* 11/2016 Ragot ..... H03H 17/0621
2017/0133027 A1* 5/2017 Kovesi ..... G10L 19/24
2017/0263263 A1* 9/2017 Kovesi ..... G10L 25/51
2017/0372714 A1* 12/2017 Kovesi ..... G10L 19/04

OTHER PUBLICATIONS

Kovesi et al., "Pre-echo reduction in the ITU-T G.729.1 embedded coder," EUSIPCO, Lausanne, Switzerland, Aug. 2008.
Mahieux et al., "High Quality Audio Transform Coding at 64 Kbps", IEEE Trans. on Communications vol. 42, No. 11, Nov. 1994.
International Search Report dated Nov. 10, 2015 for corresponding International Application No. PCT/FR2015/052433, filed Sep. 11, 2015.
Written Opinion of the International Searching Authority dated Nov. 10, 2015 for corresponding International Application No. PCT/FR2015/052433, filed Sep. 11, 2015.

* cited by examiner

DISCRIMINATION AND ATTENUATION OF PRE ECHOES IN A DIGITAL AUDIO SIGNAL

CROSS-REFERENCE TO RELATED APPLICATIONS

This Application is a Section 371 National Stage Application of International Application No. PCT/FR2015/052433, filed Sep. 11, 2015, the content of which is incorporated herein by reference in its entirety, and published as WO 2016/038316 on Mar. 17, 2016, not in English.

FIELD OF THE DISCLOSURE

The invention relates to a method and a device for discriminating and processing the attenuation of the pre-echos in the decoding of a digital audio signal.

BACKGROUND OF THE DISCLOSURE

For the transmission of digital audio signals over telecommunication networks, whether they are fixed or mobile networks for example, or for the storage of the signals, compression (or source coding) processes are used that implement coding systems which are generally of the linear predication time coding or transform frequency coding type.

The field of application of the method and the device that are the subjects of the invention is therefore the compression of the sound signals, in particular the digital audio signals coded by frequency transform.

FIG. 1 represents, by way of illustration, a theoretical block diagram of the coding and the decoding of a digital audio signal by transform including an overlap/addition analysis-synthesis according to the prior art.

Some music sequences, such as percussions and certain speech segments such as the plosives (/k/, /t/, . . . ), are characterized by extremely abrupt onsets which are reflected by very rapid transitions and a very strong variation of the dynamic range of the signal in the space of a few samples. One example of transition is given in FIG. 1 based on the sample 410.

For the coding/decoding processing, the input signal is decomposed into blocks of samples of length L whose boundaries are represented in FIG. 1 by vertical dotted lines. The input signal is denoted x(n), in which n is the index of the sample. The breakdown into successive blocks (or frames) leads to the definition of the blocks $X_N(n)=[x(N\cdot L) \ldots x(N\cdot L+L-1)]=[x_N(0) \ldots x_N(L-1)]$, where N is the index of the block (or of the frame), L is the length of the frame. In FIG. 1, there are L=160 samples. In the case of the modified discrete cosine transform MDCT, two blocks $X_N(n)$ and $X_{N+1}(n)$ are analyzed jointly to give a block of transformed coefficients associated with the frame of index N and the analysis window is sinusoidal.

The division into blocks, also called frames, applied by the transform coding is totally independent of the sound signal and the transitions can therefore appear at any point of the analysis window. Now, after transform decoding, the reconstructed signal is affected by "noise" (or distortion) generated by the quantization (Q)– inverse quantization ($Q^{-1}$) operation. This coding noise is temporarily distributed relatively uniformly over all the temporal support of the transformed block, that is to say over the entire length of the window of length 2L of samples (with overlap of L samples). The energy of the coding noise is generally proportional to the energy of the block and is a function of the coding/decoding bit rate.

For a block including an onset (like the block 320-480 of FIG. 1), the energy of the signal is high, the noise is therefore also of high level.

In transform coding, the level of the coding noise is typically lower than that of the signal for the high energy segments which immediately follow the transition, but the level is higher than that of the signal for the lower energy segments, in particular over the part preceding the transition (samples 160-410 of FIG. 1). For the abovementioned part, the signal-to-noise ratio is negative and the resulting degradation can appear very disturbing in the listening. The coding noise prior to the transition is called pre-echo and the noise following the transition is called post-echo.

It can be seen in FIG. 1 that the pre-echo affects the frame preceding the transition and the frame where the transition occurs.

Psycho-acoustic experiments have demonstrated that the human ear performs a temporal pre-masking of the sounds that is fairly limited, of the order of a few milliseconds. The noise preceding the onset, or pre-echo, is audible when the duration of the pre-echo is greater than the pre-masking duration.

The human ear also performs a post-masking of a longer duration, from 5 to 60 milliseconds, upon the transition from high-energy sequences to low-energy sequences. The rate or level of disturbance that is acceptable for the post-echos is therefore greater than for the pre-echos.

The pre-echo phenomenon, more critical, is all the more disturbing when the length of the blocks in terms of number of samples is great. Now, in transform coding, it is well known that, for the standing signals, the more the length of the transform increases, the greater the coding gain. At a fixed sampling frequency and at a fixed bit rate, if the number of points of the window (therefore the length of the transform) is increased, there will be more bits per frame to code the frequency rays deemed useful by the physchoacoustical model, hence the advantage of using blocks of great length. The MPEG AAC (Advanced Audio Coding) coding, for example, uses a window of great length which contains a fixed number of samples, 2048, i.e. over a duration of 64 ms if the sampling frequency is 32 kHz; the problem of the pre-echos is managed therein by making it possible to switch from these long windows to 8 short windows through intermediate windows (called transition windows), which necessitates a certain delay in the coding to detect the presence of a transition and adapt the windows. The length of these short windows is therefore 256 samples (8 ms at 32 kHz). At low bit rate, it is still possible to have an audible pre-echo of a few ms. The switching of the windows makes it possible to attenuate the pre-echo, but not to eliminate it. The transform coders used for the conversational applications, such as ITU-T G.722.1, G.722.1C or G.719, often used a frame length of 20 ms and a window of 40 ms duration at 16, 32 or 48 kHz (respectively). It can be noted that the ITU-T G.719 coder incorporates a window switching mechanism with transient detection, but the pre-echo is not completely reduced at low bit rate (typically at 32 Kbit/s).

In order to reduce the abovementioned disturbing effect of the pre-echo phenomenon, various solutions have been proposed in the coder and/or the decoder.

The window switching has already been cited; it necessitates transmitting an auxiliary information item to identify the type of windows used in the current frame. Another solution consists in applying an adaptive filtering. In the zone preceding the onset, the reconstructed signal is seen as the sum of the original signal and of the quantization noise.

A corresponding filtering technique has been described in the article entitled High Quality Audio Transform Coding at 64 Kbit/s, IEEE Trans. on Communications Vol 42, No. 11, November 1994, published by Y. Mahieux and J. P. Petit.

The implementation of such a filtering requires knowledge of parameters of which some, like the prediction coefficients and the variance of the signal corrupted by the pre-echo, are estimated in the decoder from noisy samples. However, information such as the energy of the original signal can be known only to the coder and must consequently be transmitted. This entails transmitting additional information, which, at constrained bit rate, reduces the relative budget allocated to the transform coding. When the received block contains an abrupt variation of the dynamic range, the filtering processing is applied to it.

The abovementioned filter process does not make it possible to restore the original signal, but provides a strong reduction of the pre-echos. It does however entail transmitting the additional parameters to the decoder.

Unlike the above solutions, various pre-echo reduction techniques without specific transmission of the information have been proposed. For example, a review of the reduction of pre-echos in the context of hierarchical coding is presented in the article by B. Kövesi, S. Ragot, M. Gartner, H. Taddei, entitled "Pre-echo reduction in the ITU-T G.729.1 embedded coder," EUSIPCO, Lausanne, Switzerland, August 2008.

A typical example of pre-echo attenuation processing method without auxiliary information is described in the French patent application FR 08 56248. In this example, attenuation factors are determined for each sub-block, in the low-energy sub-blocks preceding a sub-block in which a transition or onset has been detected.

The attenuation factor g(k) in the kth sub-block is calculated for example as a function of the ratio R(k) between the energy of the highest energy sub-block and the energy of the kth sub-block concerned:

$$g(k)=f(R(k))$$

in which f is a decreasing function with values between 0 and 1 and k is the number of the sub-block. Other definitions of the factor g(k) are possible, for example as a function of the energy En(k) in the current sub-block and of the energy En(k−1) in the preceding sub-block.

If the energy of the sub-blocks varies little relative to the maximum energy in the sub-blocks considered in the current frame, no attenuation is then necessary; the factor g(k) is set at an attenuation value inhibiting the attenuation, that is to say 1. Otherwise, the attenuation factor lies between 0 and 1.

In most cases, above all when the pre-echo is disturbing, the frame which precedes the pre-echo frame has a uniform energy which corresponds to the energy of a low-energy segment (typically a background noise). From experiments, it is neither useful nor even desirable for, after pre-echo attenuation processing, the energy of the signal to become lower than the average energy (per sub-block) of the signal preceding the processing zone—typically that of the preceding frame, denoted $\overline{En}$, or that of the second half of the preceding frame, denoted $\overline{En}'$.

For the sub-block of index k to be processed, the limit value, denoted $\lim_g(k)$, of the attenuation factor can be calculated in order to obtain exactly the same energy as the average energy per sub-block of the segment preceding the sub-block to be processed. This value is of course limited to a maximum of 1 since it is the attenuation values that are of interest here. More specifically, the following is defined here:

$$\lim_g(k) = \min\left(\sqrt{\frac{\max(\overline{En}, \overline{En'})}{En(k)}}, 1\right)$$

in which the average energy of the preceding segment is approximated by the value max ($\overline{En}$,$\overline{En}'$).

The $\lim_g(k)$ value thus obtained serves as a lower limit in the final calculation of the attenuation factor of the sub-block, it is therefore used as follows:

$$g(k)=\max(g(k),\lim_g(k))$$

The attenuation factors (or gains) g(k) determined for the sub-blocks can then be smoothed by a smoothing function applied sample-by-sample to avoid abrupt variations of the attenuation factor at the boundaries of the blocks.

For example, the gain per sample can first of all be defined as a piecewise constant function:

$$g_{pre}(n)=g(k),\ n=kL',\ \ldots,\ (k+1)L'-1$$

in which L' represents the length of a sub-block.

The function is then smoothed according to the following equation:

$$g_{pre}(n):=\alpha g_{pre}(n-1)+(1-\alpha)g_{pre}(n),\ n=0,\ \ldots,\ L-1$$

with the convention that $g_{pre}(-1)$ is the last attenuation factor obtained for the last sample of the preceding sub-block, α is the smoothing coefficient, typically α=0.85.

Other smoothing functions are also possible such as, for example, the linear cross-fade over u samples:

$$g_{pre}(n) = \frac{1}{u}\sum_{i=0}^{u-1} g'_{pre}(n-i),$$

$$n = 0, \ldots, L-1$$

in which $g_{pre}'(n)$ is the non-smooth attenuation and $g_{pre}(n)$ is the smoothed attenuation, $g_{pre}'(n)$ with n=−(u−1), . . . , −1 are the last u−1 attenuation factors obtained for the last samples of the preceding sub-block. u=5 can for example be taken.

Once the factors $g_{pre}(n)$ have thus been calculated, the attenuation of pre-echos is done on the reconstructed signal in the current frame, $x_{rec}(n)$, by multiplying each sample by the corresponding factor:

$$x_{rec,g}(n)=g_{pre}(n)x_{rec}(n),\ n=0,\ \ldots,\ L-1$$

in which $x_{rec,g}(n)$ is the signal decoded and post-processed by the pre-echo reduction.

FIGS. 2 and 3 illustrate the implementation of the attenuation method as described in the prior art patent application, mentioned above and summarized previously.

In these examples, the signal is sampled at 32 kHz, the length of the frame is L=640 samples and each frame is divided into 8 sub-blocks of K=80 samples.

In the part a) of FIG. 2, a frame of an original signal sampled at 32 kHz is represented. An onset (or transition) in the signal is situated in the sub-block commencing with the index 320. This signal has been coded by a transform coder of MDCT type at low bit rate (24 Kbit/s).

In the part b) of FIG. 2, the result of the decoding without pre-echo processing is illustrated. The pre-echo from the sample 160 can be observed, in the sub-blocks preceding the one containing the onset.

The part c) shows the trend of the pre-echo attenuation factor (continuous line) obtained by the method described in the abovementioned prior art patent application. The dotted line represents the factor before smoothing. Note here that the position of the onset is estimated around the sample 380 (in the block delimited by the samples 320 and 400).

The part d) illustrates the result of the decoding after application of the pre-echo processing (multiplication of the signal b) with the signal c)). It can be seen that the pre-echo has indeed been attenuated. FIG. 2 shows also that the smoothed factor does not go back to 1 at the moment of the onset, which implies a reduction of the amplitude of the onset. The perceptible impact of this reduction is very low but can nevertheless be avoided. FIG. 3 illustrates the same example as FIG. 2, in which, before smoothing, the attenuation factor value is forced to 1 for the few samples of the sub-block preceding the sub-block where the onset is situated. The part c) of FIG. 3 gives an example of such a correction.

In this example, the factor value 1 has been assigned to the last 16 samples of the sub-block preceding the onset, from the index 364. Thus, the smoothing function progressively increases the factor to have a value close to 1 at the moment of the onset. The amplitude of the onset is then preserved, as illustrated in the part d) of FIG. 3, but a few pre-echo samples are not attenuated.

In the example of FIG. 3, the reduction of pre-echo by attenuation does not make it possible to reduce the pre-echo to the level of the onset, because of the smoothing of the gain.

This pre-echo reduction technique can however be perfected for some types of signals such as modern music signals for example. In effect, in some cases, a false pre-echo detection can take place. FIG. 4 illustrates an example of such an original signal, uncoded and therefore without pre-echo. It is a beating of an electronic/synthetic percussion instrument. It can be seen here that, before the clear onset toward the index 1600, there is a synthetic noise which starts toward the index 1250. This synthetic noise which therefore forms part of the signal would be detected as a pre-echo by the pre-echo detection algorithm described above, assuming a perfect coding/decoding of the signal. The pre-echo attenuation processing would therefore eliminate this component of the signal. This would distort the decoded signal (when the coding/decoding is perfect), which is not desirable.

There is therefore a need for an enhanced technique for discriminating and attenuating pre-echos in decoding, which makes it possible to make the detection of the pre-echos reliable and avoid the false detections without any auxiliary information being transmitted by the coder.

SUMMARY

An exemplary embodiment of the present invention relates to a method for discriminating and attenuating pre-echo in a digital audio signal generated from a transform coding, in which, for a current frame decomposed into sub-blocks, the low-energy sub blocks preceding a sub-block in which a transition or onset is detected determine a pre-echo zone in which a pre-echo attenuation processing is carried out. The method is such that, in the case where an onset is detected from the third sub-block of the current frame, it comprises the following steps:

calculation of a leading coefficient of the energies for at least two sub-blocks of the current frame preceding the sub-block in which an onset is detected;

comparison of the leading coefficient to a predefined threshold; and inhibition of the pre-echo attenuation processing in the pre-echo zone in the case where the calculated leading coefficient is below the predefined threshold.

The leading coefficient of the energies calculated for the sub-blocks preceding the position of the onset makes it possible to verify the upward trend of the energy of the signal in the pre-echo zone. This makes it possible to make the detection of the pre-echos reliable by avoiding false pre-echo detection. In effect, referring to FIG. 1, it can be seen that the pre-echo has a typical characteristic: its energy has an increasing trend approaching the onset originating the pre-echo. The form of the overlap-addition weighting windows explains that. Even though the pre-echo has an energy that is almost constant before the addition-overlap, the signals at the input of the overlap-addition module are multiplied by weighting windows whose weight decreases toward the past. In the case of the exemplary signal of FIG. 4, the energy of the signal before the onset is approximately constant which makes it possible to differentiate a pre-echo. Thus, the verification of an increasing energy of the signal in the pre-echo zone makes it possible to increase the reliability of the pre-echo detection.

In a particular embodiment, the method further comprises a step of decomposition of the digital audio signal into at least two sub-signals as a function of a frequency criterion, and the comparison calculation steps are performed for at least one of the sub-signals.

When the position of the onset is detected in the third sub-block of the current frame, the energy of two sub-blocks is used in the pre-echo zone to calculate a leading coefficient and compare it to a threshold. With only two points, only the verification for the high-frequency sub-signal in the case of a decomposition into two sub-signals is sufficient to detect a false pre-echo detection.

In the case where the number of sub-blocks preceding the sub-block where an onset position has been detected is sufficient, the method further comprises a step of decomposition of the digital audio signal into at least two sub-signals as a function of a frequency criterion, and the calculation and comparison steps are performed for each of the sub-signals, the inhibition of the pre-echo attenuation processing in the pre-echo zone of all the sub-signals being performed when a calculated leading coefficient is below the predefined threshold for at least one sub-signal.

The division into sub-signals thus makes it possible to perform a pre-echo attenuation independently and in a manner suited to the sub-signals. The pre-echo zone detection reliability is reinforced for each of the sub-signals by the verification of the value of the respective leading coefficients.

According to a particular embodiment, a different threshold is defined for each sub-signal.

This makes it possible to adapt the verification to the spectral characteristics of the sub-signals.

In one embodiment, the leading coefficient is calculated according to a least squares estimation method.

This calculation method is of low complexity.

In one possible embodiment, the leading coefficient is normalized.

Thus, the leading coefficient can more easily be compared to a threshold when the latter is different from 0.

In one possible embodiment, in the case where an onset is detected in the first or second sub-block of the current frame, a leading coefficient calculated for the preceding frame is used for the comparison step.

The present invention relates also to a device for discriminating and attenuating pre-echo in a digital audio signal generated from a transform coding, comprising a transition or onset detection module, a pre-echo zone discrimination module and a pre-echo attenuation processing module, a pre-echo attenuation processing being performed for a current frame decomposed into sub-blocks, in the low-energy sub-blocks preceding a sub-block in which a transition or onset is detected determining a pre-echo zone. The device is such that, in the case where an onset is detected from the third sub-block of the current frame, it further comprises:

- a computation module calculating a leading coefficient of the energies for at least two sub-blocks of the current frame preceding the sub-block in which an onset is detected;
- a comparator capable of performing a comparison of the leading coefficient to a predefined threshold; and
- a discrimination module capable of inhibiting the pre-echo attenuation processing in the pre-echo zone in the case where the calculated leading coefficient is below the predefined threshold.

The advantages of this device are the same as those described for the attenuation discrimination and processing method that it implements.

The invention targets a digital audio signal decoder comprising a device as described previously.

The invention also targets a computer program comprising code instructions for the implementation of the steps of the method as described previously, when these instructions are executed by a processor.

Finally, the information relates to a storage medium that can be read by a processor, integrated or not in the processing device, possibly removable, storing a computer program implementing a processing method as described previously.

BRIEF DESCRIPTION OF THE DRAWINGS

Other features and advantages of the invention will become more clearly apparent on reading the following description, given purely as a nonlimiting example, and with reference to the attached drawings, in which.

DETAILED DESCRIPTION OF ILLUSTRATIVE EMBODIMENTS

Figure 5:
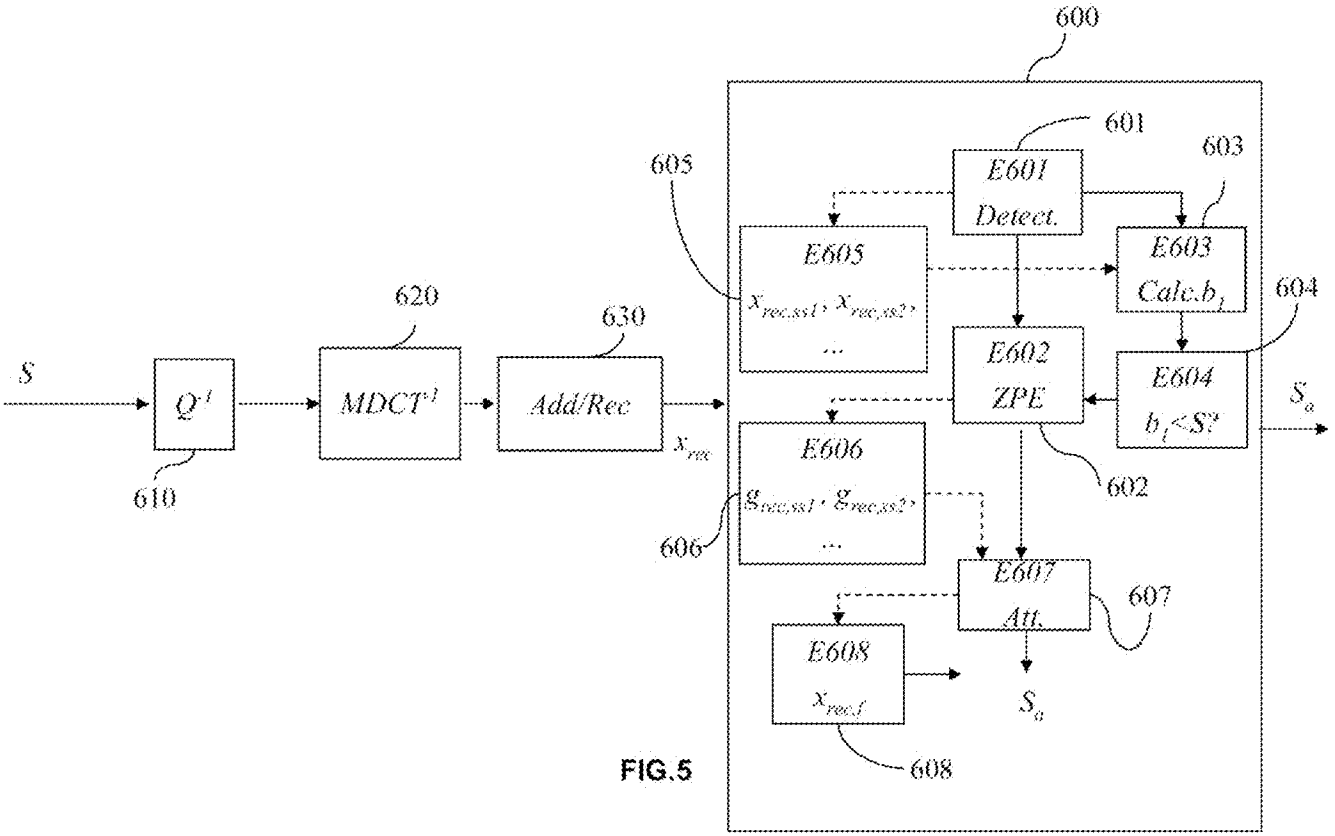
FIG. 5 illustrates an embodiment of a pre-echo discrimination and attenuation processing device included in a decoder according to the invention.

Referring to FIG. 5, a pre-echo discrimination and attenuation processing device 600 is described. The attenuation processing device 600 as described hereinbelow is included in a decoder comprising an inverse quantization module 610 ($Q^{-1}$) receiving a signal S, an inverse transform module 620 ($MDCT^{-1}$), an add-overlap signal reconstruction module 630 (add/rec) as described with reference to FIG. 1 and delivering a reconstructed signal $x_{rec}(n)$ to the discrimination and attenuation processing device according to the invention. It can be noted that the example of the MDCT transform which is most commonly used in speech and audio coding is taken here, but the device 600 applies equally to any other type of transform (FFT, DCT, etc.).

At the output of the device 600, a processed signal Sa is supplied in which a pre-echo attenuation has been performed.

The device 600 implements a pre-echo discrimination and attenuation processing method in the decoded signal od $x_{rec}(n)$.

In one embodiment of the invention, the discrimination and attenuation processing method comprises a step of detection (E601) of the onsets which can generate a pre-echo, in the decoded signal $x_{rec}(n)$.

Thus, the device 600 comprises a detection module 601 capable of implementing a step of detection (E601) of the position of an onset in a decoded audio signal.

An onset is a rapid transition and an abrupt variation of the dynamic range (or amplitude) of the signal. This type of signal can be designated by the more general term "transient". Hereinbelow and with no loss of generality, only the terms onset or transition will be used to designate also transients.

Each current frame of L samples of the decoded signal $x_{rec}(n)$ is divided into K sub-blocks of length L', with, for example, L=640 samples (20 ms) at 32 kHz, L'=80 samples (2.5 ms) and K=8. Preferably, the size of these sub-blocks is therefore identical but the invention remains valid and easily generalizable when the sub-blocks have a variable size. That may be the case for example when the frame length L is not divisible by the number of sub-blocks K or if the frame length is variable.

Special analysis-synthesis windows with low delay similar to those described in the ITU-T G.718 standard are used for the analysis part and for the synthesis part of the MDCT transformation. An example of such windows is illustrated with reference to FIG. 6. The delay generated by the transformation is only 280 samples unlike the delay of 640 samples in the case of the use of conventional sinusoidal windows. Thus, the MDCT memory with special analysis-synthesis windows with low delay contains only a 140 independent samples (not folded with the current frame) unlike the 320 samples in the case of use of the conventional sinusoidal windows.

Figure 6:
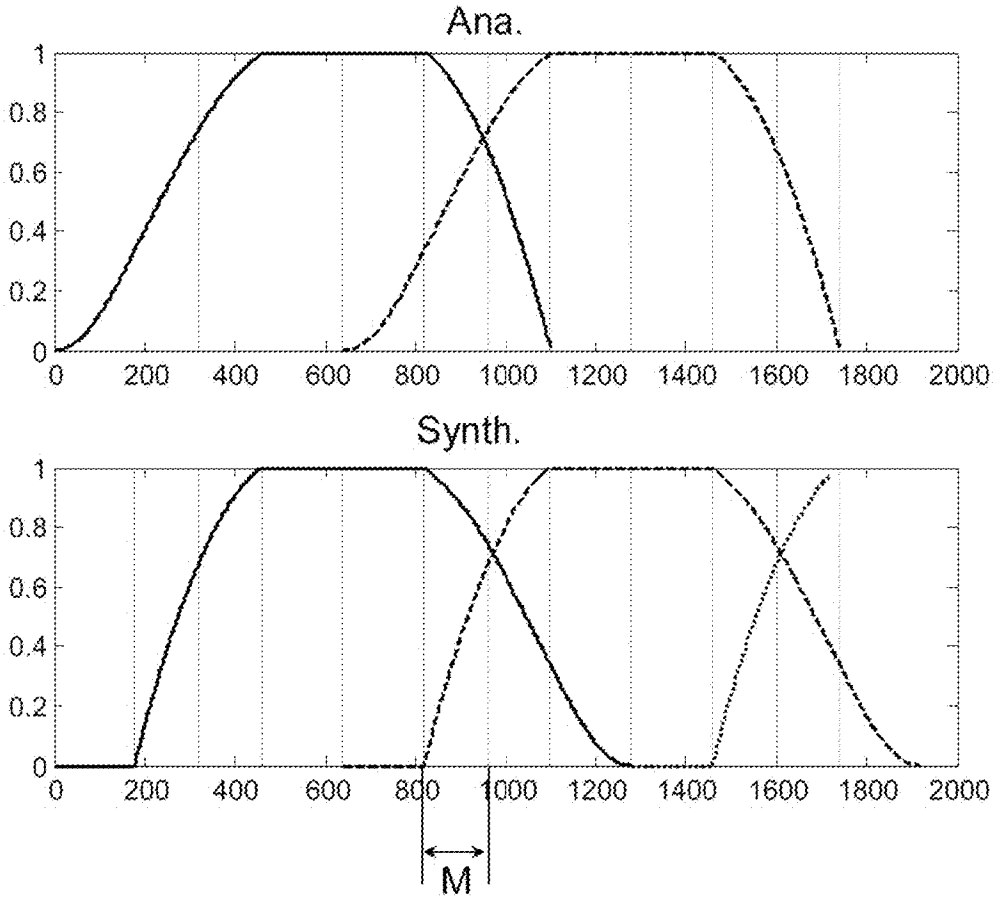
FIG. 6 illustrates an example of analysis windows and of synthesis windows with low delay for the transform coding and decoding likely to create the pre-echo phenenomon.

It can in fact be noted in FIG. 6 for the analysis windows (Ana.), that the folding zone is limited by dotted lines between the samples 820 and 1100. The folding line is represented by chain-dotted line at the sample 960.

For the synthesis (Synth.), only the samples represented by the interval M (140 samples) are necessary to obtain the information on the folding zone of the analysis, by exploiting the symmetry. These samples contained in memory are then useful for decoding this folding zone by using also the folded samples of the window of the next frame. In the case of an onset in this zone between the samples 820 and 1100, the average energy of the samples represented by the interval M is clearly greater than the energy of sub-frames preceding the sample 820. The abrupt increase in the energy of the interval M contained in the MDCT memory can therefore signal an onset in the next frame which can generate a pre-echo in the current frame.

The MDCT memory $x_{MDCT}(n)$ is used, which gives a version with temporal folding of the future signal ("folding"). With the special analysis-synthesis windows with low delay as illustrated in FIG. 6, only one (K'=1) block of length $L_m(0)=140$ is retained, which contains all the independent samples of the MDCT memory. Despite the greater number of samples in this sub-block, its energy remains comparable to that of the sub-blocks of the current frame (if the signal remains stable), because the memory part has been windowed (therefore attenuated) by the analysis window.

Figure 1:
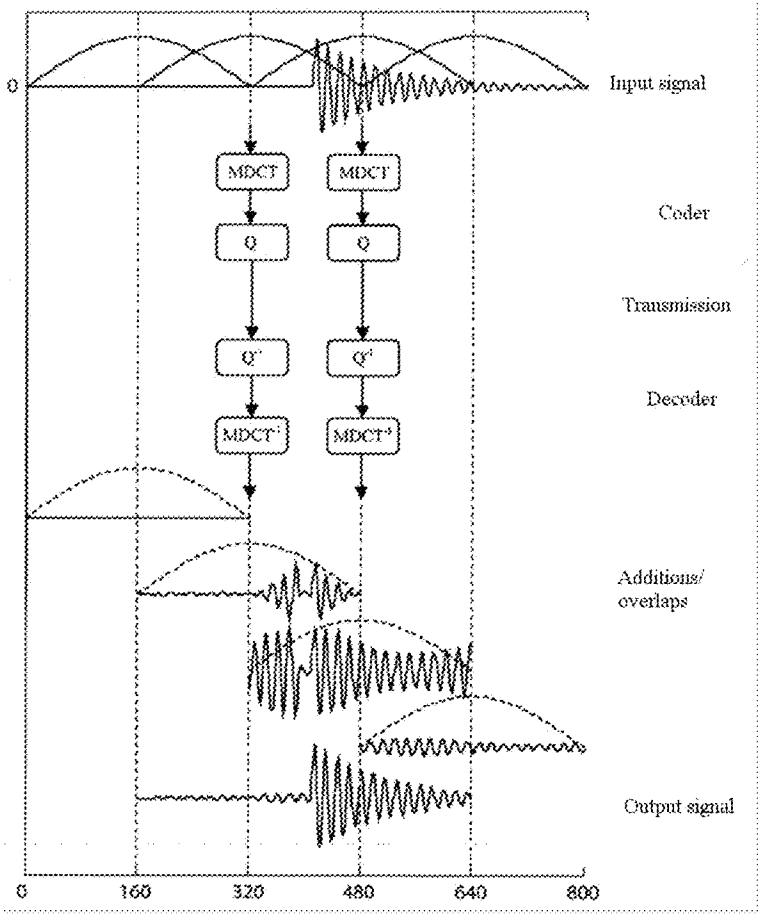
FIG. 1, described previously, illustrates a transform coding-decoding system according to the prior art.
Figure 2:
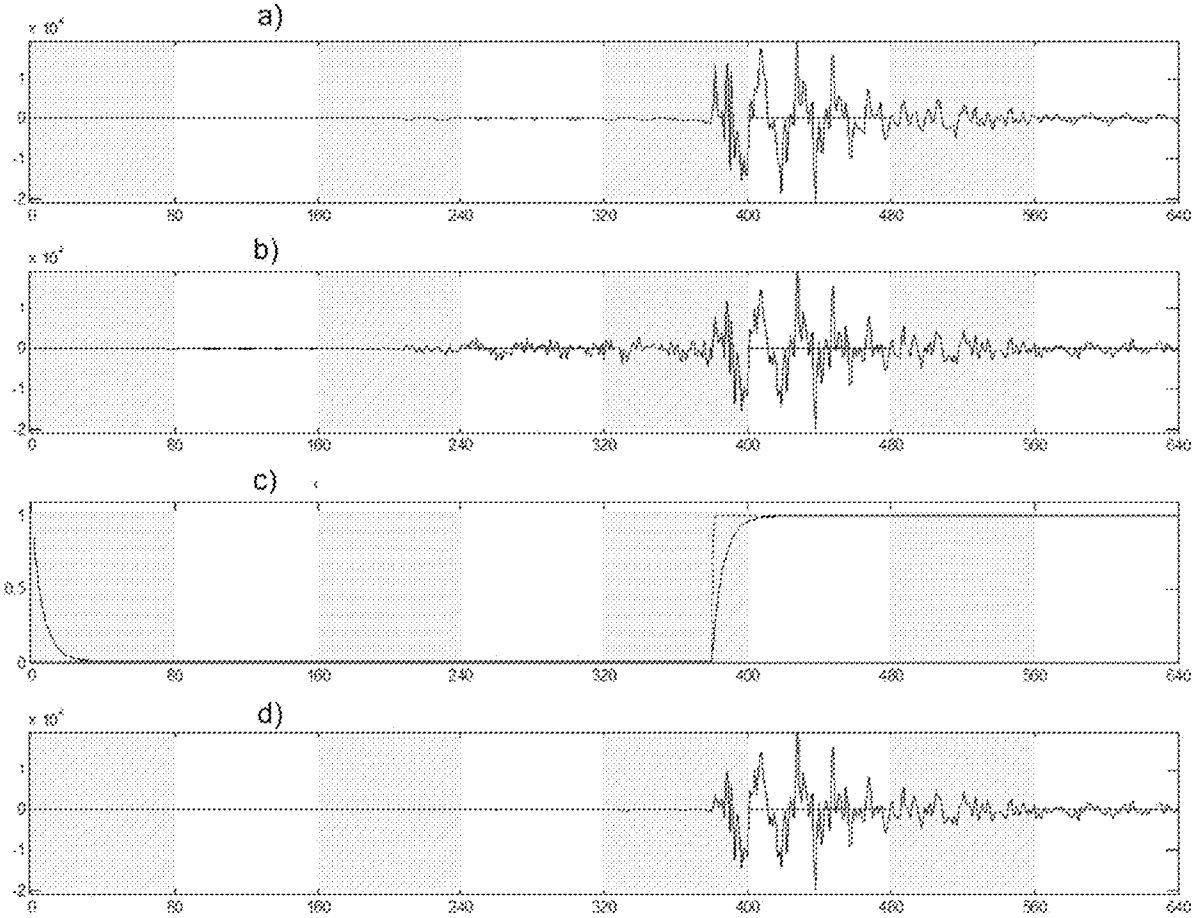
FIG. 2, described previously, illustrates an example of digital audio signal for which an attenuation method according to the prior art is performed.
Figure 3:
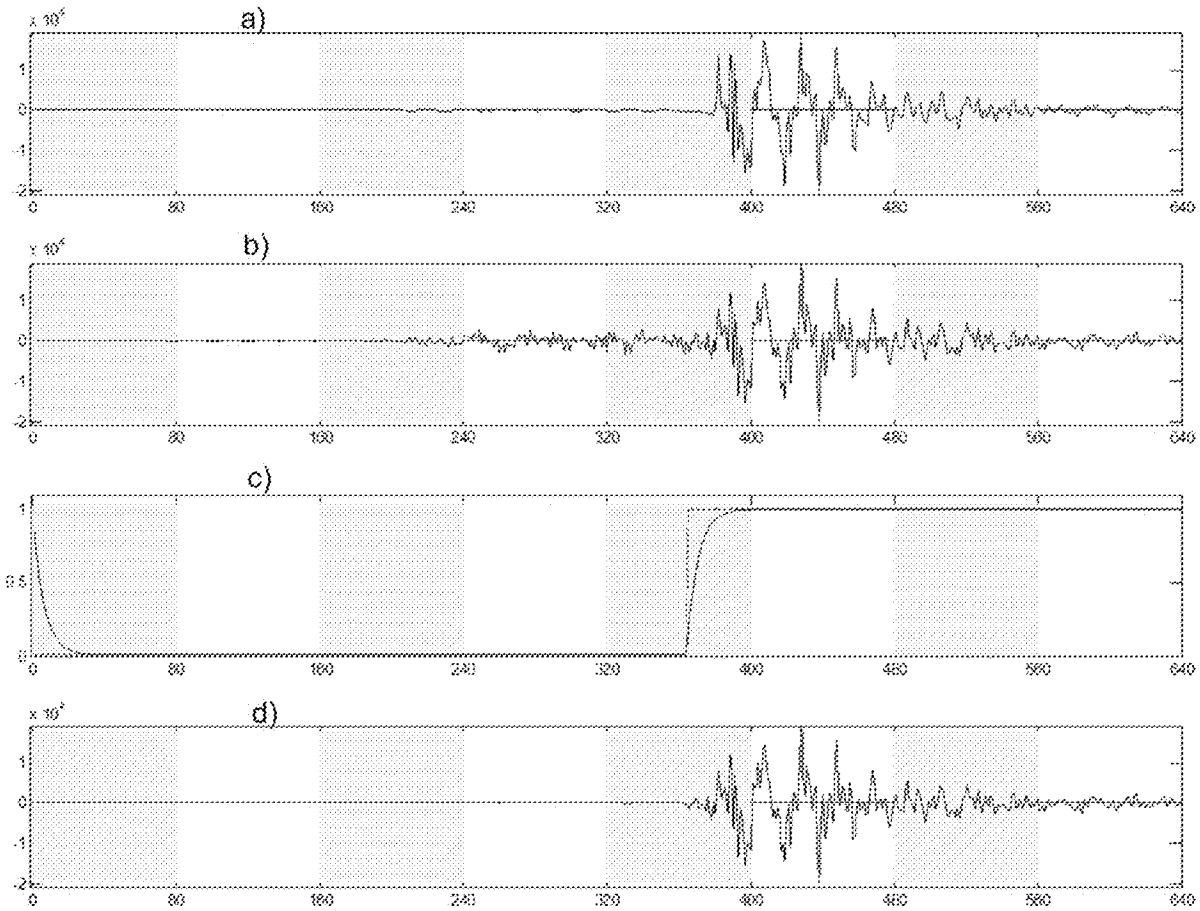
FIG. 3 illustrates another example of digital audio signal for which an attenuation method according to the prior art is performed.
Figure 4:
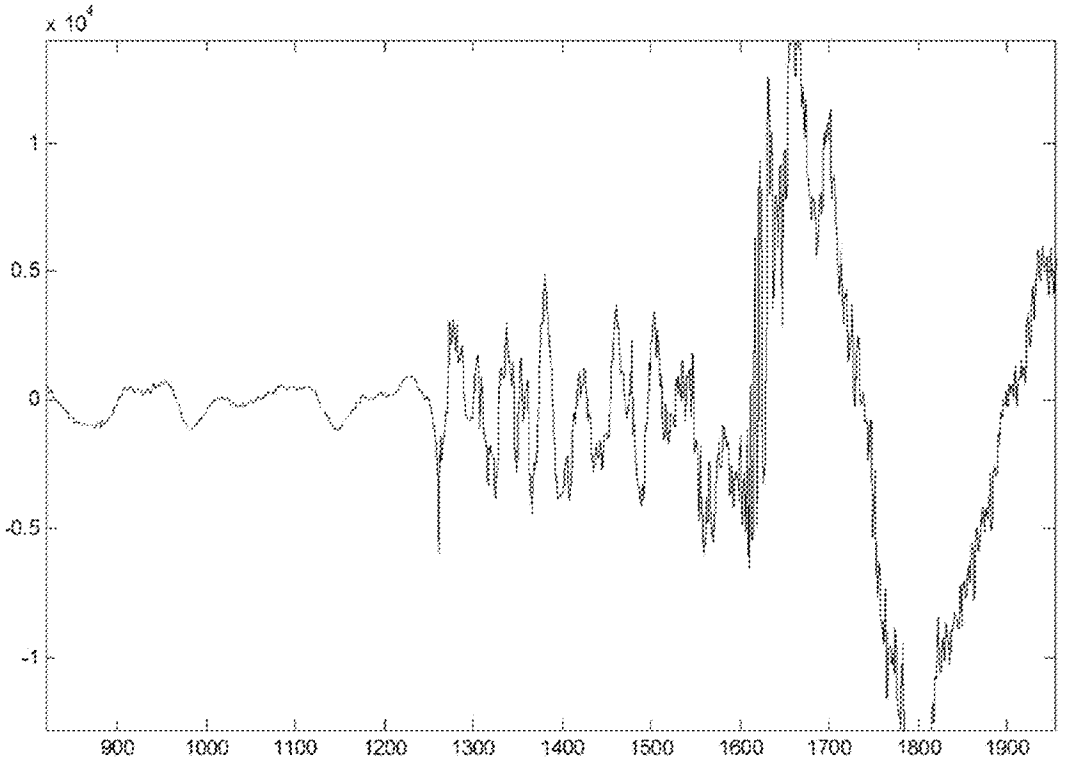
FIG. 4, described previously, illustrates an example of a signal for which the prior art technique would wrongly detect a pre-echo.

In effect, FIG. 1 shows that the pre-echo influences the frame which precedes the frame where the onset is situated, and it is desirable to detect an onset in the future frame which is partly contained in the MDCT memory.

The current frame and the MDCT memory can be seen as concatenated signals forming a signal subdivided into (K+K') consecutive sub-blocks. In these conditions, the energy in the kth sub-block is defined as:

$$En(k) = \sum_{n=kL'}^{(k+1)L'-1} x_{rec}(n)^2,$$

$$k = 0, \ldots, K-1$$

when the kth sub-block is situated in the current frame and, as:

$$En(k) = \sum_{n=0}^{L_{mem}-1} x_{MDCT}(n)^2$$

when the sub-block is in the MDCT memory (which represents the signal available for the future frame) and $L_{mem}$ is the length of the sub-block of the memory part:

The average energy of the sub-blocks in the current frame is therefore obtained as:

$$\overline{En} = \frac{1}{K}\sum_{k=0}^{K-1} En(k)$$

The average energy of the sub-blocks in the second part of the current frame is also defined as (assuming that K is an even number):

$$\overline{En'} = \frac{2}{K}\sum_{k=K/2}^{K-1} En(k)$$

An onset associated with a pre-echo is detected if the ratio $$R(k) = \frac{\max_{n=0,K+K'-1}(En(n))}{En(k)}$$

exceeds a predefined threshold, in one of the sub-blocks considered. Other pre-echo detection criteria are possible without changing the nature of the invention.

Moreover, the position of the onset is considered to be defined as $$pos = \min\left(L' \cdot \left(\arg \max_{k=0,K+K'-1}(En(k))\right), L\right)$$

in which the limitation to L ensures that the MDCT memory is never modified. Other more accurate methods for estimating the position of the onset are also possible.

The device 600 also comprises a pre-echo zone discrimination module 602 implementing a step of determination (E602) of a pre-echo zone (ZPE) preceding the detected onset position. Here, the term pre-echo zone is used to denote the zone covering the samples before the estimated position of the onset which are disturbed by the pre-echo generated by the onset and where the attenuation of this pre-echo is desirable. In the embodiment presented, the pre-echo zone can be determined on the decoded signal.

In one embodiment of obtaining pre-echo zones, the energies En(k) are concatenated in chronological order, with, first of all, the time envelope of the decoded signal, then the envelope of the signal of the next frame estimated from MDCT transform memory. Based on this concatenated time envelope and the average energies $\overline{En}$ and $\overline{En'}$ of the preceding frame, the presence of pre-echo is detected for example if the ratio R(k) exceeds a threshold, typically this threshold is 16.

The sub-blocks in which a pre-echo has been detected thus constitute a pre-echo zone, which generally covers the samples n=0, . . . , pos−1, i.e. from the start of the current frame to the position of the onset (pos). It can also be noted that the pre-echo zone can very well extend over all the current frame if the onset has been detected in the future frame.

The device 600 comprises a computation module 603 capable of implementing a step of calculation of a leading coefficient (or variation trend indicator) of the energies of the sub-blocks preceding the sub-block in which an onset has been detected.

The linear model which represents a set of n realizations $(t_i, e_i)$, $0<=i<n$ is defined in with $t_i$ are the time indexes of the sub-blocks and $e_i$ are their energies, with the equation $$e=b_0+b_1 t \tag{1}$$

In which $b_0$ is the value at the instant t=0 and $b_1$ is the leading coefficient. The leading coefficient gives the information on the trend (average) of variation of the energy. A positive leading coefficient signals an increase in the energies. A value close to 0 signals a constant energy.

The value of $b_1$ can be determined by linear least squares regression:

$$b_1 = \frac{\sum (t_i - \bar{t})(e_i - \bar{e})}{\sum (t_i - \bar{t})^2} \tag{2}$$

In which the summation is performed over predetermined indexes i.

The value of $b_1$ depends also on the quantity (as absolute value) of the energies; it is in effect uniform with the energy over time. To be able to better compare the value of $b_1$ to a threshold (for example fixed), this dependency can be eliminated. For example, the value of $b_1$ can be divided by the average value of the energies to obtain the normalized leading coefficient:

$$b_{1n} = \frac{b_1 n}{\sum e_i} \tag{3}$$

Alternatively, the correlation coefficient will be able to be taken.

$$b_{1n_alt} = \frac{\sum (t_i - \bar{t})(e_i - \bar{e})}{\sqrt{\sum (t_i - \bar{t})^2 \Sigma (e_i - \bar{\bar{e}})^2}} \tag{4}$$

This alternative solution has a higher calculation complexity because it involves calculating a square root.

Other methods for estimating the leading coefficient are also possible such as, for example, Tukey's median-median method.

It can also be noted that, when the leading coefficient has to be compared to a zero value threshold—which amounts to verifying the sign of this coefficient—it is not necessary to normalize this coefficient.

Moreover, instead of normalizing the leading coefficient, it will be possible to make the threshold variable because the following relations are equivalent:

$$b_{1n} = \frac{b_1 n}{\sum e_i} > \text{threshold}$$

$$b_1 < \text{threshold} \cdot \frac{\sum e_i}{n}$$

If the onset is detected in the first or second sub-block, the verification according to the invention is not possible. If the onset is detected in the third sub-block the energy of two sub-blocks in the pre-echo zone, $e_0$ and $e_1$, is available to make this verification ($e_1$ being closest to the onset). With 2 points, the equation (3) is simplified thus:

$$b_{1n} = \frac{2(e_1 - e_0)}{e_1 + e_0} \tag{5}$$

If the onset is detected in the fourth sub-block, there is the energy of 3 sub-blocks in the pre-echo zone, $e_0$, $e_1$ and $e_2$, available to make this verification ($e_2$ being closest to the onset). With 3 points the equation (3) is simplified thus:

$$b_{1n} = \frac{3(e_2 - e_0)}{2(e_2 + e_1 + e_0)} \tag{6}$$

If there are 4 or more sub-blocks, the leading coefficient can be calculated over 4 or more sub-blocks. Experiments show that the verification of the leading coefficient calculated over the 3 sub-blocks preceding the sub-block where the onset has been detected is sufficient to avoid false pre-echo detections—this conclusion applies for the case of 8 sub-blocks on each 20 ms frame and can be adapted according to the size of the sub-blocks and of the frame.

Thus, in the preferred embodiment, the leading coefficient is calculated with at most 3 sub-blocks. This makes it possible to limit the maximum complexity of the calculation of the leading coefficient.

According to the invention, the normalized leading coefficient $b_{1n}$ thus obtained is then compared in the step E604 by a comparator module 604 to a predefined threshold. The threshold can be predefined with a fixed value or can be variable as a function, for example of the classification of the signal according to a speech or music criterion. Typically, this threshold is equal to 0 if it is verified only that the energy does not decrease or is equal to 0.2 if a slight increase of the energy is imposed in the pre-echo zone. If the normalized leading coefficient $b_{1n}$ is below this threshold, it is concluded that the signal in the pre-echo zone does not correspond to a typical pre-echo and the attenuation of the pre-echoes in this zone is inhibited in the step E602. Thus, the situation of a decoded signal whose original input signal contains a low-energy component before an onset being modified/altered in error by the pre-echo attenuation module by detecting this component as a pre-echo is avoided.

A pre-echo attenuation is implemented in the step E607 by the attenuation module 607 for the discriminated pre-echo zone. The attenuation factor is for example calculated as in the application FR 08 56248. In the case where the module 604 has detected a false pre-echo detection, the attenuation factor can be forced to 1, thus inhibiting the attenuation or else the discrimination module 602 does not discriminate this zone as a pre-echo zone, the attenuation module then not being invoked.

In a particular embodiment, the device 600 further comprises a signal decomposition module 605, capable of performing a step E605 of decomposition of the decoded signal into at least two sub-signals according to a predetermined criterion. This method is notably described in the application FR12 62598 of which a few elements are recalled here.

In a particular embodiment of the invention, the decoded signal $x_{rec}(n)$ is decomposed in the step E605 into two sub-signals as follows:

The first sub-signal $x_{rec,ss1}(n)$ is obtained by low-pass filtering by using an FIR filter (finite impulse response filter) with 3 coefficients and zero phase of transfer function $c(n)z^{-1}+(1-2c(n))+c(n)z$ with c(n) a value lying between 0 and 0.25, in which [c(n),1−2c(n),c(n)] are the coefficients of the low-pass filter; this filter is implemented with the differences equation:

$$x_{rec,ss1}(n)=c(n)x_{rec}(n-1)+(1-2c(n))x_{rec}(n)+c(n)x(n+1)$$

In a particular embodiment, a constant value c(n)=0.25 is used. It can be noted that the sub-signal $x_{rec,ss1}(n)$ resulting from this filtering therefore contains predominantly low-frequency components of the decoded signal.

the second sub-signal $x_{rec,ss2}(n)$ is obtained by complementary high-pass filtering by using an FIR filter with 3 coefficients and with zero phase of transfer function $-c(n)z^{-1}+2c(n)-c(n)z$, in which [−c(n),2c(n),−c(n)] are the coefficients of the high-pass filter; this filter is implemented with the differences equation: $x_{rec,ss2}(n)=-c(n)x_{rec}(n-1)+2c(n)x_{rec}(n)-c(n)x(n+1)$. The sub-signal $x_{rec,ss2}(n)$ resulting from this filtering therefore contains predominantly high-frequency components of the decoded signal.

Note that $x_{rec,ss1}(n)+x_{rec,ss2}(n)=x_{rec}(n)$.

It is therefore also possible to obtain $x_{rec,ss2}(n)$ by subtracting $x_{rec,ss1}(n)$ from $x_{rec}(n)$ which reduces the complexity of the calculations: $x_{rec,ss2}(n)=x_{rec}(n)-x_{rec,ss1}(n)$.

The combination of the attenuated sub-signals to obtain the attenuated signal Sa is done by simple addition of the attenuated sub-signals in the step E608 described below.

So as not to use a future signal for these filterings, it is for example possible to complement the decoded signal with a 0 sample at the end of the block. In the case of the decoded signal complemented with a 0 sample at the end of the block for n=L−1, the sub-signal $x_{rec,ss1}(n)$ is obtained by:

$$x_{rec,ss1}(L-1)=c(L-1)x_{rec}(L-2)+(1-2c(L-1))x_{rec}(L-1),$$

$x_{rec,ss2}(n)$ is always calculated as $x_{rec,ss2}(n)=x_{rec}(n)-x_{rec,ss1}(n)$.

It can be noted that the two sub-signals here still have the same sampling frequency as the decoded signal.

A step E606 of calculation of pre-echo attenuation factors is implemented in the computation module 606. This calculation is done separately for the two sub-signals.

These attenuation factors are obtained for each sample of the pre-echo zone determined in E602 as a function of the frame in which the onset has been detected and of the preceding frame.

The factors $g_{pre,ss1}'(n)$ and $g_{pre,ss2}'(n)$ are then obtained in which n is the index of the corresponding sample. These factors will, if necessary, be smoothed to obtain the factors $g_{pre,ss1}(n)$ and $g_{pre,ss2}(n)$ respectively. This smoothing is important above all for the sub-signals containing the low-frequency components (therefore for $g_{pre,ss1}'(n)$ in this example).

An example of realization of the attenuation calculation is described in the patent application FR 08 56248. The attenuation factors are calculated for each sub-block. In the method described here, they are, in addition, calculated separately for each sub-signal. For the samples preceding the detected onset, the attenuation factors $g_{pre,ss1}'(n)$ and $g_{pre,ss2}'(n)$ are therefore calculated. Next, these attenuation values are, if necessary, smoothed to obtain the attenuation values for each sample.

The calculation of the attenuation factor of a sub signal (for example $g_{pre,ss2}'(n)$) can be similar to that described in the patent application FR 08 56248 for the decoded signal as a function of the ratio R(k) (used also for the detection of the onset) between the energy of the highest energy sub-block and the energy of the kth sub-block of the decoded signal. $g_{pre,ss2}'(n)$ is initialized as:

$$g_{pre,ss2}'(n)=g(k)=f(R(k)),n=kL', \ldots, (k+1)L'-1;\ k=0,\ldots,K-1$$

in which f is a decreasing function with values between 0 and 1, for example f=0 if R(k)<=16, f=0.1 if 16>R(k)>=32 and f=0.01 if r(k)>32.

If the variation of the energy relative to the maximum energy is low, no attenuation is then necessary. The factor is then set at an attenuation value inhibiting the attenuation, that is to say 1. Otherwise, the attenuation factor lies between 0 and 1. This initialization can be common for all the sub-signals.

The attenuation values are then refined for each sub-signal to be able to set the optimal attenuation level per sub-signal as a function of the characteristics of the decoded signal. For example, the attenuations can be limited as a function of the average energy of the sub-signal of the preceding frame because it is not desirable for, after the pre-echo attenuation processing, the energy of the signal to become lower than the average energy per sub-block of the signal preceding the processing zone (typically that of the preceding frame or that of the second half of the preceding frame).

This limitation can be done in a way similar to that described in the patent application FR 08 56248. For example, for the second sub-signal $x_{rec,ss2}(n)$ the energy in the K sub-blocks of the current frame is first of all calculated as:

$$En_{ss2}(k)=\sum_{n=kL'}^{(k+1)L'-1} x_{rec,ss2}(n)^2,\ k=0,\ldots,K-1$$

Also known from memory are the average energy of the preceding frame $\overline{En_{ss2}}$ and that of the second half of the preceding frame $\overline{En_{ss2}}'$ which can be calculated (on the preceding frame) as:

$$\overline{En_{ss2}}=\frac{1}{K}\sum_{k=0}^{K-1} En_{ss2}(k) \text{ and } \overline{En'_{ss2}}=\frac{2}{K}\sum_{k=K/2}^{K-1} En_{ss2}(k)$$

in which the sub-block indexes from 0 to K correspond to the current frame.

For the sub-block k to be processed, the limit value of the factor $\lim_{g,ss2}(k)$ can be calculated in order to obtain exactly the same energy as the average energy per sub-block of the segment preceding the sub-block to be processed. This value is of course limited to a maximum of 1 since the interest here is on the attenuation values. More specifically:

$$\lim_{g,ss2}(k)=\min\left(\sqrt{\frac{\max(\overline{En_{ss2}},\overline{En'_{ss2}})}{En_{ss2}(k)}},1\right)$$

in which the average energy of the preceding segment is approximated by max $(\overline{En_{ss2}}, \overline{En_{ss2'}})$.

The value $\lim_{g,ss2}(k)$ thus obtained serves as lower limit in the final calculation of the attenuation factor of the sub-block:

$$g_{pre,ss2}'(n)=\max(g_{pre,ss2}'(n),\lim_{g,ss2}(k)),\ n=kL',\ldots,(k+1)L'-1;\ k=0,\ldots,K-1$$

In a first variant embodiment, the pre-echo zone in which the attenuation extends from the start of the current frame to the start of the sub-block in which the onset has been detected—up to the index pos where $$pos=\min\left(L'\cdot\left(\arg\max_{k=0,K+K'-1}(En(k))\right),L\right).$$

The attenuations associated with the samples of the sub-block of the onset are all set to 1 even if the onset is situated toward the end of this sub-block.

In another variant embodiment, the start position of the onset pos is refined in the sub-block of the onset, for example by subdividing the sub-block into sub-sub-blocks by observing the trend of the energy of these sub-sub-blocks. Assuming that the onset start position is detected in the sub-block k, k>0 and the start of the refined onset pos is located in this sub-block, the attenuation values for the samples of this sub-block which are located before the pos index can be initialized as a function of the attenuation value corresponding to the last sample of the preceding sub-block:

$$g_{pre,ss2}'(n)=g_{pre,ss2}'(kL'-1),\ n=kL',\ \ldots,\ \text{pos}-1$$

All the attenuations from the pos index are set to 1.

For the first sub-signal containing the low-frequency components of the decoded signal, the calculation of the attenuation values based on the sub-signal $x_{rec,ss1}(n)$ can be similar to the calculation of the attenuation values based on the decoded signal $x_{rec}(n)$. Thus, in a variant embodiment, in the interests of reducing the complexity of calculation, the attenuation values can be determined based on the decoded signal $x_{rec}(n)$. In the case where the detection of the onsets is made on the decoded signal, it is therefore no longer necessary to recalculate energies of the sub-blocks because, for this signal, the energy values per sub-block are already calculated to detect the onsets. Since, for the great majority of the signals, the low frequencies are much more energy-intensive than the high frequencies, the energies per sub-block of the decoded signal $x_{rec}(n)$ and the sub-signal $x_{rec,ss1}(n)$ are very close, this approximation gives a very satisfactory result.

The attenuation factors $g_{pre,ss1}(n)$ and $g_{pre,ss2}(n)$ determined for each sub-block can then be smoothed by a smoothing function applied sample-by-sample to avoid abrupt variations of the attenuation factor at the boundaries of the blocks. This is particularly important for the sub-signals containing low-frequency components like the sub-signal $x_{rec,ss1}(n)$ but not necessary for the sub-signals containing only high-frequency components like the sub-signal $x_{rec,ss2}(n)$.

Figure 7:
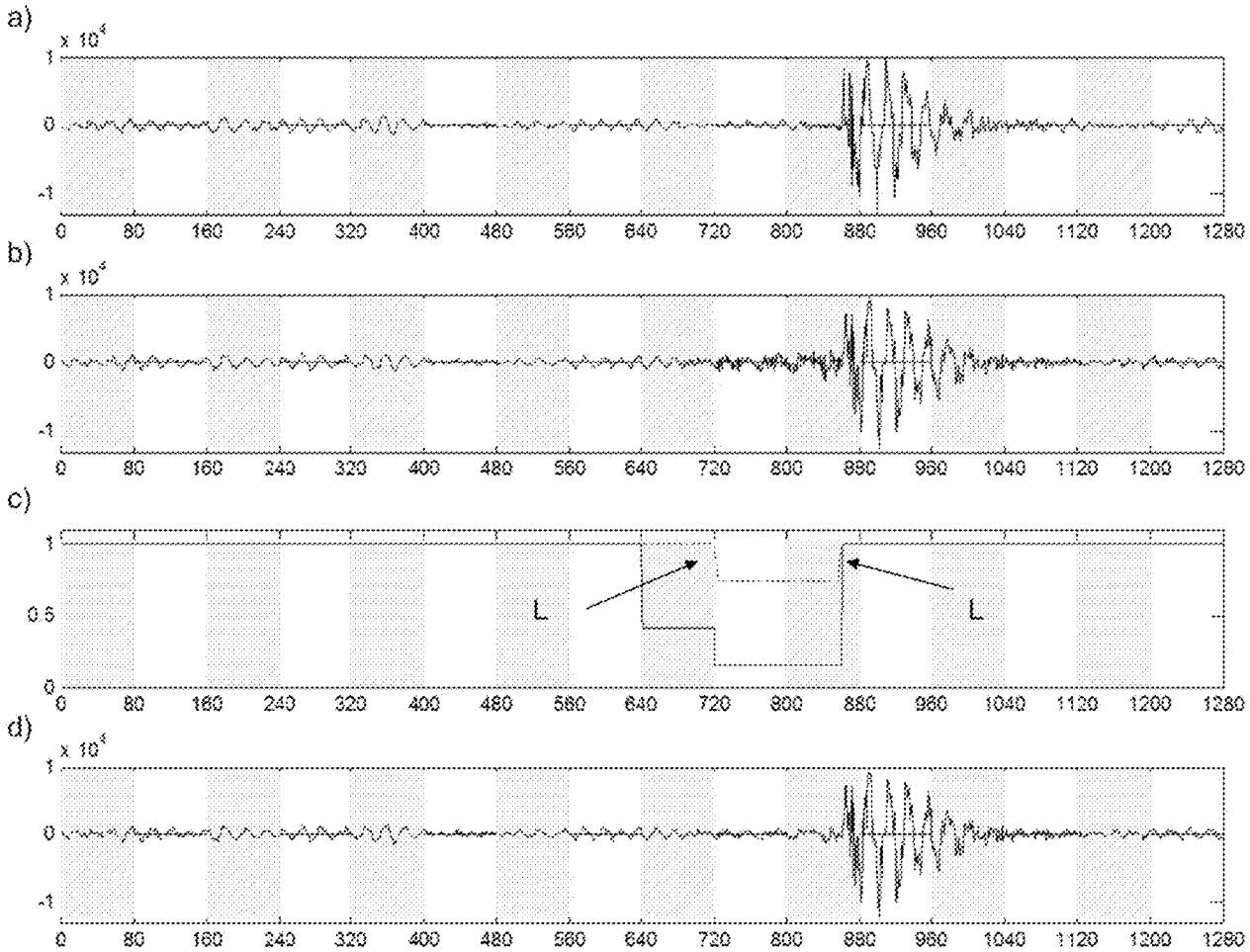
FIG. 7 illustrates an example of digital audio signal for which the pre-echo attenuation method according to an embodiment of the invention is implemented.

FIG. 7 illustrates an example of application of an attenuation gain with smoothing functions represented by the arrows L.

This figure illustrates in a), an example of original signal, in b), the signal decoded without pre-echo attenuation, in c), the attenuation gains for the two sub-signals obtained according to the decomposition step E605 and in d), the signal decoded with pre-echo attenuation of the steps E607 and E608 (that is to say after combination of the two attenuated sub-signals).

It can be seen in this figure that the attenuation gain represented by dotted line and corresponding to the gain calculated for the first sub-signal comprising low-frequency components, comprises smoothing functions as described above. The attenuation gain represented by solid line and calculated for the second sub-signal comprising high-frequency components does not comprise any smoothing gain.

The signal represented in d) clearly shows the pre-echo has been attenuated effectively by the attenuation processing implemented.

The smoothing function is for example defined preferably by the following equations:

$$g_{pre,ss1}(n)=\frac{1}{u}\sum_{i=0}^{u-1}g'_{pre,ss1}(n-i),\ n=0,\ \ldots,\ L-1$$

with the convention that $g_{pre,ss1}'(n)n=-(u-1),\ldots,-1$ are the last u−1 attenuation factors obtained for the last samples of the sub-block preceding the sub-signal $x_{rec,ss1}(n)$. Typically u=5 but another value could be used. Depending on the smoothing used, the pre-echo zone (the number of the samples attenuated) can therefore be different for the two sub-signals processed separately, even if the detection of the onset is made in common on the basis of the decoded signal.

The smoothed attenuation factor does not go back up to 1 at the time of the onset, which implies a reduction of the amplitude of the onset. The perceptible impact of this reduction is very low but should nevertheless be avoided. To mitigate this problem, the attenuation factor value can be forced to 1 for the u−1 samples preceding the pos index where the start of the onset is situated. This is equivalent to advancing the pos marker by u−1 samples for the sub-signal where the smoothing is applied. Thus, the smoothing function progressively increases the factor to have a value 1 at the moment of the onset. The amplitude of the onset is then preserved.

In this embodiment with decomposition of the signal, the verification of the increase in energy of the pre-echo zone according to the invention is performed for at least one sub-signal or for each of these sub-signals.

The comparison threshold used can be different according to the sub-signals and according to the number of sub-blocks available before the onset.

If, in at least one sub-signal, the normalized leading coefficient $b_{1n}$ is below the threshold of this sub-signal, the attenuation of the pre-echoes is inhibited for all the sub-signals.

In the case of pre-echoes in a signal deriving from an inverse MDCT transform, the energy of the pre-echo component increases or is at least stable in all the sub-signals. The inhibition of pre-echo processing can be done for example by setting the attenuation factors at 1 or by not discriminating the zone as a pre-echo zone, the pre-echo attenuation processing module then not being invoked as illustrated by way of example in the embodiment of FIG. 5 by the link between the block 604 and 602.

In variants, the attenuation will be inhibited separately for each sub-signal as soon as the normalized leading coefficient $b_{1n}$ is below the threshold of this sub-signal. The inhibition will be able to be implemented for example by setting the attenuation factors at 1 or by not invoking the pre-echo module for the sub-signal considered.

Thus, in the particular embodiment described above with decomposition into two sub-signals, if the number of sub-blocks before the onset makes it possible to make this verification, the trend of the energy of the sub-blocks preceding the sub-block where the onset has been detected is verified, in the two sub-signals, by linear regression. This verification can be done according to the steps E603 and E604, at any moment after the division of the decoded signal into sub-signals (E605) and before the application of the attenuation factors of the pre-echoes (E607). The verification is possible if at least two sub-blocks precede the sub-block where the onset has been detected. If the onset is detected in the first or second sub-block, the verification according to the invention is not possible.

In variants, it will be possible to re-use the leading coefficient(s) possibly calculated in the preceding frame if the onset is detected in the first or second sub-block of the current frame.

If the onset is detected in the third sub-block, the energy of two sub-blocks in the pre-echo zone is then available to make this verification. By experimentation, with two points, the verification is not sufficiently reliable in the low-frequency sub-signal $x_{rec,ss1}(n)$. Only the high-frequency sub-signal $x_{rec,ss2}(n)$ is then verified, and only that the energy does not decrease. The leading coefficient of the high-frequency sub-signal $x_{rec,ss2}(n)$ is compared to the 0 value threshold. Only its sign is important here, no normalization is needed. It is therefore sufficient to calculate, in the step E603, a single leading coefficient (without normalization) as:

$$b_{1ss2}=En_{ss2}(1)-En_{ss2}(0)$$

If $b_{1ss2}$ is less than 0, the attenuation of the pre-echoes for this pre-echo zone is inhibited for all the sub-signals.

If the onset is detected in the fourth sub-block or a sub-block of index higher than 4, the trend of the energy of the last 3 sub-blocks in the pre-echo zone preceding the sub-block where the onset has been detected is verified. The leading coefficient of the low-frequency sub-signal $x_{rec,ss1}$ (n) is compared to 0, only its sign is important and there is no need to normalize this coefficient. It is therefore sufficient to calculate a single leading coefficient. If the onset has been detected in the sub-block of index id with id>=3, this coefficient is determined as:

$$b_{1ss1}=En(id-1)-En_{ss2}(id-3)$$

If $b_{1ss1}$ is less than 0, the attenuation of the pre-echoes is inhibited for this pre-echo zone, and for all the sub-signals.

The leading coefficient of the high-frequency sub-signal $x_{rec,ss2}(n)$ is compared to a threshold of value 0.2. The normalized leading coefficient is calculated. If the onset has been detected in the sub-block of index id with id>=3, this coefficient is determined as:

$$b_{1nss2}=\frac{3(En_{ss2}(id-1)-En_{ss2}(id-2))}{2(En_{ss2}(id-1)+En_{ss2}(id-2)+En_{ss2}(id-3))}$$

If $b_{1nss2}$ is less than 0.2, the attenuation of the pre-echoes is inhibited for this pre-echo zone, and for all the sub-signals.

Note that the condition $$\frac{3(En_{ss2}(id-1)-En_{ss2}(id-2))}{2(En_{ss2}(id-1)+En_{ss2}(id-2)+En_{ss2}(id-3))}<0.2$$

is equivalent to $$En_{ss2}(id-1)-En_{ss2}(id-2)<\frac{1}{7.5}(En_{ss2}(id-1)+En_{ss2}(id-2)+En_{ss2}(id-3))$$

thus avoiding a division operation to reduce the complexity and to facilitate the implementation on a DSP processor (Digital Signal Processor) with fixed point arithmetic.

The module 607 of the device 600 of FIG. 5 implements the step E607 of pre-echo attenuation in the pre-echo zone of each of the sub-signals by application to the sub-signals of the attenuation factors thus calculated.

The pre-echo attenuation is therefore done independently in the sub-signals. Thus, in the sub-signals representing different frequency bands, the attenuation can be chosen as a function of the spectral distribution of the pre-echo.

Finally, a step E608 of the obtaining module 608 makes it possible to obtain the attenuated output signal (the decoded signal after pre-echo attenuation) by combination (in this example by simple addition) of the attenuated sub-signals, according to the equation:

$$x_{rec,f}(n)=g_{pre,ss1}(n)x_{rec,ss1}(n)+g_{pre,ss2}(n)x_{rec,ss2}(n),\quad n=0,\ldots,L-1$$

Unlike a conventional decomposition into sub-bands, it can be noted here that the filterings used are not associated with sub-signal decimation operations and the complexity and the delay ("lookahead" or future frame) are reduced to the minimum.

Figure 8:
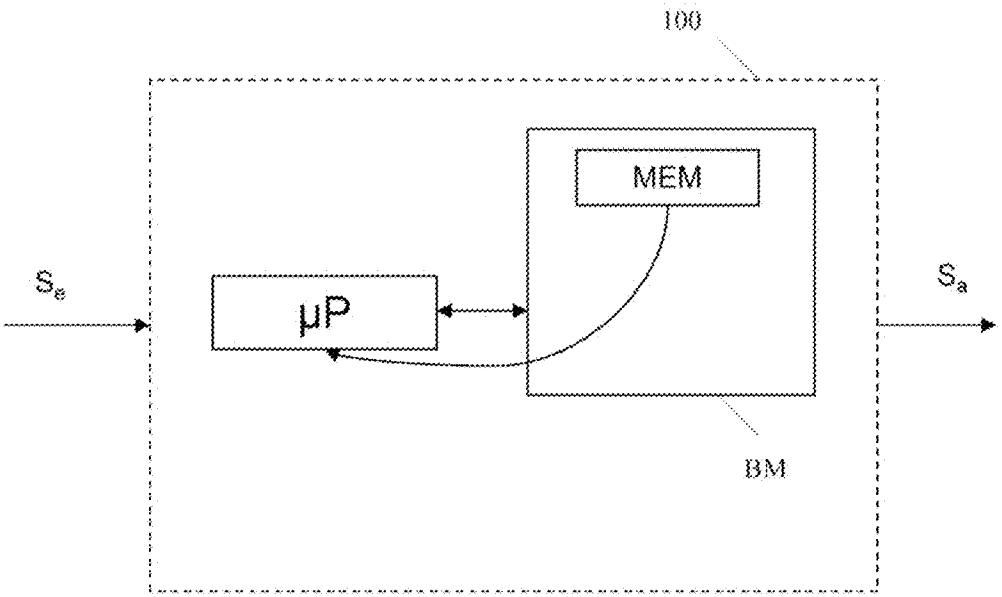
FIG. 8 illustrates a hardware example of a discrimination and attenuation processing device according to the invention.

An exemplary embodiment of an attenuation discrimination and processing device according to the invention is now described with reference to FIG. 8.

Physically, this device 100 within the meaning of the invention typically comprises a processor μP cooperating with a memory block BM including a storage memory and/or working memory, and a buffer memory MEM mentioned above as means for storing all the data necessary to the implementation of the discrimination and attenuation processing method as described with reference to FIG. 5. This device receives as input successive frames of the digital signal Se and delivers the signal Sa reconstructed with pre-echo attenuation in the discriminated pre-echo zones, with, if appropriate, reconstruction of the attenuated signal by combination of the attenuated sub-signals.

The memory block BM can comprise a computer program comprising code instructions for the implementation of the steps of the method according to the invention when these instructions are executed by a processor μP of the device and in particular the steps of calculation of a leading coefficient of the energies for at least two sub-blocks preceding the sub-block in which an onset is detected, of comparison of the leading coefficient to a predefined threshold and of inhibition of the pre-echo attenuation processing in the pre-echo zone in the case where the calculated leading coefficient is below the predefined threshold.

FIG. 5 can illustrate the algorithm of such a computer program.

This discrimination and attenuation processing device according to the invention can be independent or incorporated in a digital signal decoder. Such a decoder can be incorporated in digital audio signal storage or transmission equipment items such as communication gateways, communication terminals or servers of a communication network.

An exemplary embodiment of the present disclosure improves the prior art situation.

Although the present disclosure has been described with reference to one or more examples, workers skilled in the art will recognize that changes may be made in form and detail without departing from the scope of the disclosure and/or the appended claims.

The invention claimed is:

1. A method for discriminating and attenuating pre-echo in a digital audio signal generated from a transform coding, in which, upon decoding, for a current frame decomposed into sub-blocks, the method comprises the following acts performed by a processing device:

performing a pre-echo attenuation processing in a pre-echo zone determined by the low-energy sub-blocks preceding a sub-block in which a transition or onset is detected; and in the case where an onset is detected from a third sub-block of the current frame, performing the following acts by the processing device:

calculating a leading coefficient of energies for at least two sub-blocks of the current frame comprising a first and a second sub-block preceding the sub-block in which an onset is detected;

comparing the leading coefficient to a predefined threshold;

inhibiting the pre-echo attenuation processing in the pre-echo zone in the case where the calculated leading coefficient is below the predefined threshold; and delivering a processed digital audio signal resulting from the acts of performing the pre-echo attenuation processing and the inhibiting.

2. The method as claimed in claim 1, further comprising decomposing the digital audio signal into at least two sub-signals as a function of a frequency criterion and wherein the comparing and calculating acts are performed for at least one of the sub-signals.

3. The method as claimed in claim 1, further comprising decomposing the digital audio signal into at least two sub-signals as a function of a frequency criterion, wherein the calculating and comparing acts are performed for each of the sub-signals, the inhibiting the pre-echo attenuation processing in the pre-echo zone of all the sub-signals is performed when a calculated leading coefficient is below the predefined threshold for at least one sub-signal.

4. The method as claimed in claim 3, wherein a different threshold is defined for each sub-signal.

5. The method as claimed in claim 1, wherein the leading coefficient is calculated according to a least squares estimation method.

6. The method as claimed in claim 1, wherein the leading coefficient is normalized.

7. The method as claimed in claim 1, wherein, in the case where an onset is detected in the first or second sub-block of the current frame, a leading coefficient calculated for the preceding frame is used for the comparing act.

8. A device for discriminating and attenuating pre-echo in a digital audio signal generated by a transform coder, the device being associated with a decoder and comprising:

a non-transitory computer-readable medium comprising instructions stored thereon; and a processor configured by the instructions to performs acts comprising, upon decoding of the digital audio signal, for a current frame decomposed into sub-blocks, the following acts:

performing a pre-echo attenuation processing in a pre-echo zone determined by the low-energy sub-blocks preceding a sub-block in which a transition or onset is detected; and in the case where an onset is detected from a third sub-block of the current frame, performing the following acts by the processing device:

calculating a leading coefficient of energies for at least two sub-blocks of the current frame preceding the sub-block in which an onset is detected;

comparing the leading coefficient to a predefined threshold;

inhibiting the pre-echo attenuation processing in the pre-echo zone in the case where the calculated leading coefficient is below the predefined threshold; and delivering a processed digital audio signal resulting from the acts of performing the pre-echo attenuation processing and the inhibiting.

9. A digital audio signal decoder comprising the device as claimed in claim 8.

10. A non-transitory computer-readable storage medium that can be read by a pre-echo discrimination and attenuation processing device and on which is stored a computer program comprising code instructions for executing a method of discriminating and attenuating pre-echo in a digital audio signal generated from a transform coding, when the instructions are executed by a processor, wherein the method comprises the following acts, upon decoding of the digital audio signal, for a current frame decomposed into sub-blocks:

performing a pre-echo attenuation processing in a pre-echo zone determined by the low-energy sub-blocks preceding a sub-block in which a transition or onset is detected; and in the case where an onset is detected from a third sub-block of the current frame, performing the following acts by the processing device:

calculating a leading coefficient of energies for at least two sub-blocks of the current frame preceding the sub-block in which an onset is detected;

comparing the leading coefficient to a predefined threshold;

inhibiting the pre-echo attenuation processing in the pre-echo zone in the case where the calculated leading coefficient is below the predefined threshold; and delivering a processed digital audio signal resulting from the acts of performing the pre-echo attenuation processing and the inhibiting.

* * * * *